US005761937A

United States Patent [19]

Adelmeyer

[11] Patent Number: 5,761,937

[45] Date of Patent: Jun. 9, 1998

[54] AUXILIARY LOCK

[75] Inventor: Gerard G. Adelmeyer, Anaheim, Calif.

[73] Assignee: Emhart Inc., Newark, Del.

[21] Appl. No.: 683,185

[22] Filed: Jul. 18, 1996

Related U.S. Application Data

[63] Continuation of Ser. No. 350,599, Dec. 7, 1994, abandoned.

[51] Int. Cl.[6] ..... E05B 9/08

[52] U.S. Cl. ..... 70/370; 70/381; 70/134; 292/DIG. 60

[58] Field of Search ..... 70/370, 447–452, 70/379 R, 381, DIG. 60; 292/337

[56] References Cited

U.S. PATENT DOCUMENTS

| | | | |
|---|---|---|---|
| 2,207,878 | 7/1940 | Schlage | 70/370 |
| 3,934,437 | 1/1976 | Crepinsek | 70/370 |
| 4,073,172 | 2/1978 | Schlage | 70/370 |
| 4,338,804 | 7/1982 | Solovieff | 70/134 |
| 4,489,576 | 12/1984 | Mullich et al. | 70/370 |
| 4,869,083 | 9/1989 | DeMarseilles et al. | 70/452 |
| 5,316,353 | 5/1994 | McKernan | 70/448 |
| 5,351,513 | 10/1994 | Ellis | 70/370 |

*Primary Examiner*—Steven N. Meyers
*Assistant Examiner*—Tuyet-Phuong Pham
*Attorney, Agent, or Firm*—Spencer T. Smith

[57] ABSTRACT

An auxiliary lock comprises a latch assembly having an elongated casing to be received by a first horizontal bore extending into the end of the door. A cylinder mechanism is received by a second horizontal thru bore extending, from one face of the door to the other face of the door and intersecting the first bore. The cylinder mechanism includes a cylinder having a chimney, a cylindrical guard having an annular door engaging surface, an annular lip projecting inwardly from the annular door engaging surface to be received by the second thru bore, a cylindrical segment projecting inwardly from the annular lip, and a strut projecting radially upwardly from one circumferential end of the segment and defining therewith a shaped structure. The strut has a length selected so that the shaped structure lies proximate the bottom of the casing to thereby prevent the rotation of the said guard.

5 Claims, 3 Drawing Sheets

AUXILIARY LOCK

This application is a continuation of Ser. No. 08/350,599 filed Dec. 7, 1994 now abandoned.

The present invention relates to auxiliary locks, often referred to as deadbolts, and more particularly to auxiliary locks having a torque limiting feature.

Auxiliary locks conventionally have design features for deterring illegal entries. For example, cylinder guards are provided for enclosing the locking cylinder housing. These guards may have an annular lip extending into the door hole to restrict access by screwdrivers and the like. Torque limiting structures, which could interconnect to or be integral with the guard, may also be provided which will cooperate with the latch casing for preventing rotation of the guard which could break the mounting screws.

U.S. Pat. No. 4,338,804 discloses a single cylinder auxiliary lock having a circumferential shield which usually has a pair of opposed cutouts (two cutouts will make the shield reversible and capable of cooperating with a long latch assembly casing). This shield combines the desired annular lip and torque limiting features. In the '804 patent the shield and the cylinder guard are separate parts but in a cast unit these two parts could be part of the exterior guard.

It is an object of the present invention to provide a universal cast exterior/interior guard having an annular lip and a torque limiting feature so that a single cylinder auxiliary lock can be assembled using one cast guard and a double cylinder auxiliary lock can be assembled using two of these identical guards.

It is also an object of the present invention to provide a universal cast exterior/interior guard that can be used as the interior and exterior guard with doors having a thickness which varies between predefined limits (1 3/8" to 1 3/4," for example).

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figures 1, 2:
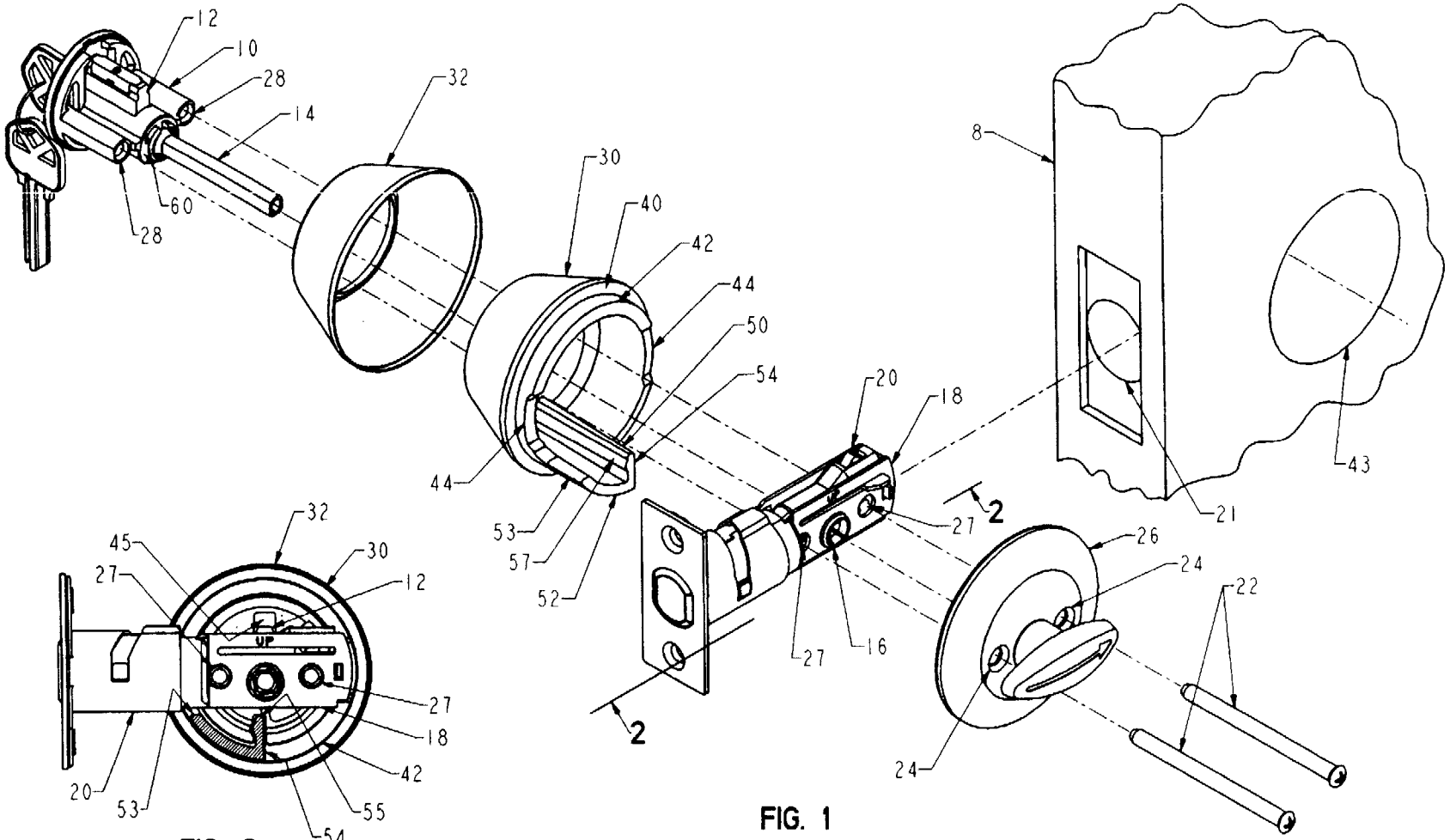
FIG. 1 is an oblique separated view showing a single cylinder deadbolt incorporating the teachings of the present invention.
FIG. 2 is a view taken at 2—2 of FIG. 1.

A single cylinder auxiliary lock is shown in FIG. 1. On the exterior side of a door 8 is located a cylinder housing portion 10 of a cylinder assembly which includes a chimney 12 (the location of the locking pins) and an axially extending torque blade 14 which enters a suitable thru hole 16 in the casing 18 of the latch assembly 20 which is received in a latch hole 21 in the door.

To secure the auxiliary lock to the door, a pair of mounting screws 22 extend through holes 24 in an interior turn piece and rose assembly 26, through holes 27 in the latch assembly 20, and are received by threaded holes 28 in the cylinder housing portion 10. To protect the cylinder housing portion 10, a cylinder guard 30 is provided which is dressed with a cover 32. The cylinder guard has an annular flat door engaging surface 40 which will be forced into engagement with the door during assembly and a cylindrical or annular lip 42 which has a diameter selected so that it will fit into the lockset hole 43 in the door 8. Opposed cutouts 44 are provided on the annular lip to accommodate the latch casing 18. Referring to FIG. 2, the opening in the front face of the guard includes a slot 45 to receive or capture the chimney 12 of the associated cylinder housing thereby properly orienting the cylinder guard and preventing relative rotation.

Projecting into the door and beneath the casing 18 is a shaped tongue 50 which occupies one quadrant defined by vertical and horizontal lines intersecting the axis of the lockset hole of the lockset hole and which is defined by a cylindrical inwardly extending segment 52 which is a continuation of the annular lip 42 and a radial strut 54 which projects vertically upwardly from the lower edge of the segment and continues rearwardly to the front of the cylinder guard. As can be seen from FIG. 2, the top 55 of the radial strut 54 and the top end 53 of the cylindrical segment 52 end beneath and proximate to the latch casing thereby preventing rotation of the cylinder guard 30 in either direction. The strut extends toward the exterior end of the housing 10 to provide support for housing barrel 60 and has a slight rib 57 to strengthen the structure.

Figure 3:
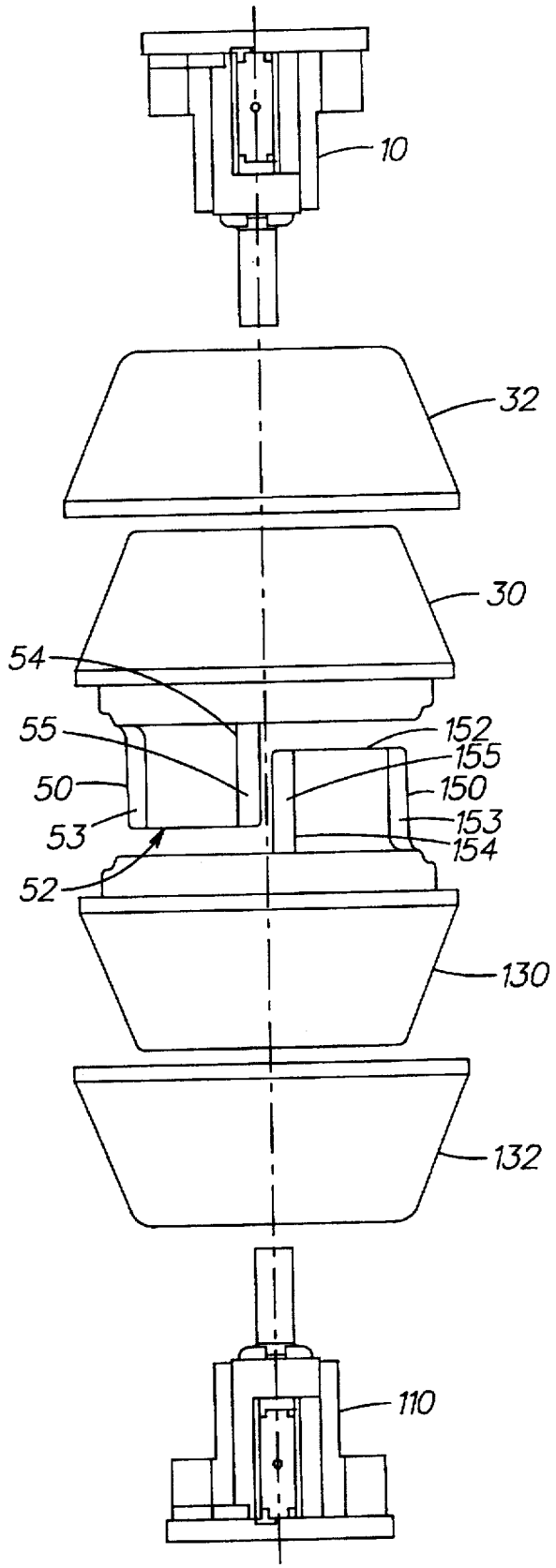
FIG. 3 is a top view showing how first and second cylinder guards would appear on a door of minimum thickness with the guard cover and cylinder housing for each guard separated.
Figure 4:
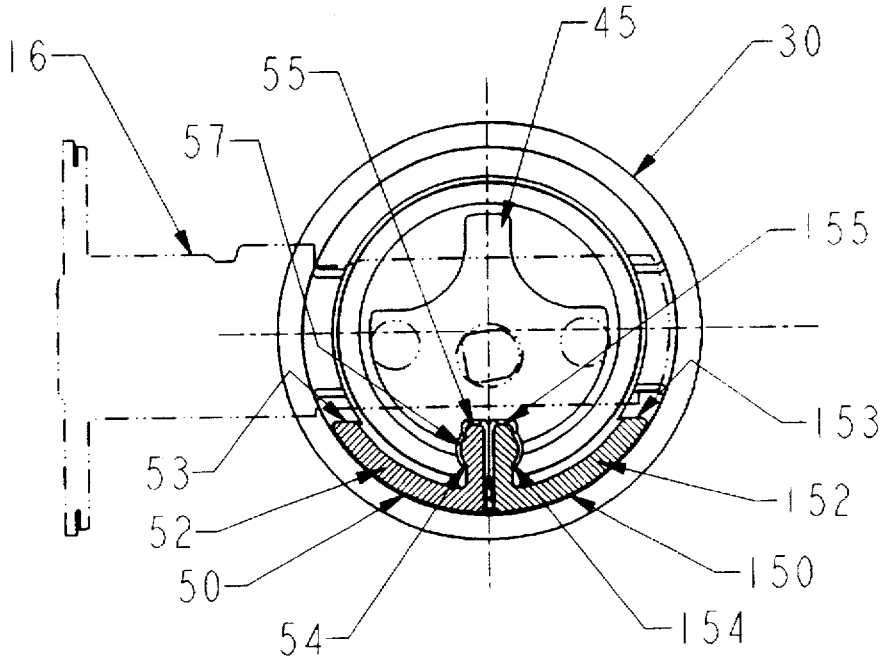
FIG. 4 is a view taken at 2—2 of FIG. 1 but showing a double cylinder configuration.

In the double lock configuration (FIGS. 3 and 4), the turn piece and rose assembly 26 is replaced by a second cylinder housing 110, guard 130 and cover 132. Since the door may vary in thickness, the torque limiting tongues 50, 150 of the cylinder guards can lie side by side beneath the latch assembly casing with the tops 53, 153 of the circular segments 52, 152 and the tops 55, 155 of the radial struts 54, 154 proximate the latch assembly casing 18.

I claim:

1. An auxiliary lock for a door having mutually perpendicular latch and lockset holes comprising a latch assembly having an elongated casing to be received by the latch hole, a cylinder lock assembly for insertion into the lockset hole including a cylinder housing having a chimney, a cylindrical guard having a front face having a chimney receiving opening for preventing relative rotation therebetween, an annular door engaging surface, an annular lip projecting inwardly from said annular door engaging surface for insertion into the lockset hole, and a torque limiting structure projecting inwardly for preventing the rotation of said cylindrical guard in either direction, said torque limiting structure occupying only one quadrant defined by horizontal and vertical lines intersecting the axis of the lockset hole, said torque limiting structure comprising a cylindrical segment projecting inwardly from said annular lip, the uppermost end of said cylindrical segment lying beneath and proximate to said casing, and a noncylindrical strut projecting radially upwardly from the other end of said cylindrical segment to a location beneath and proximate to said casing.

2. An auxiliary lock according to claim 1, further comprising a second identical cylinder lock assembly.

3. An auxiliary lock according to claim 1, wherein said strut extends rearwardly into the housing beyond said annular door engaging face.

4. An auxiliary lock according to claim 3, further comprising a second identical cylindrical lock assembly.

5. An auxiliary lock according to claim 3, wherein said cylinder housing further comprises a barrel portion and said strut underlies said barrel portion.

* * * * *